US009951433B2

(12) United States Patent
Takeuchi et al.

(10) Patent No.: US 9,951,433 B2
(45) Date of Patent: Apr. 24, 2018

(54) CONDUCTIVE FILM-FORMING BATH

(71) Applicant: OKUNO CHEMICAL INDUSTRIES CO., LTD., Osaka-shi, Osaka (JP)

(72) Inventors: Yukiya Takeuchi, Osaka (JP); Junji Yoshikawa, Osaka (JP); Koji Kita, Osaka (JP)

(73) Assignee: OKUNO CHEMICAL INDUSTRIES CO., LTD., Osaka-shi (JP)

( * ) Notice: Subject to any disclaimer, the term of this patent is extended or adjusted under 35 U.S.C. 154(b) by 0 days.

(21) Appl. No.: 15/034,424

(22) PCT Filed: Nov. 18, 2014

(86) PCT No.: PCT/JP2014/080527
§ 371 (c)(1),
(2) Date: May 4, 2016

(87) PCT Pub. No.: WO2015/111291
PCT Pub. Date: Jul. 30, 2015

(65) Prior Publication Data

US 2016/0273118 A1 Sep. 22, 2016

(30) Foreign Application Priority Data

Jan. 27, 2014 (JP) ..... 2014-012132

(51) Int. Cl.

| | |
|---|---|
| ***C23C 18/40*** | (2006.01) |
| ***C23C 18/16*** | (2006.01) |
| ***C23C 18/20*** | (2006.01) |
| ***C23C 18/24*** | (2006.01) |
| ***C23C 18/28*** | (2006.01) |
| ***C23C 18/30*** | (2006.01) |
| ***C25D 3/38*** | (2006.01) |
| ***C25D 3/04*** | (2006.01) |
| ***C25D 3/12*** | (2006.01) |
| ***C25D 5/14*** | (2006.01) |
| ***C25D 5/34*** | (2006.01) |
| ***C25D 5/54*** | (2006.01) |
| ***C25D 1/18*** | (2006.01) |

(52) U.S. Cl.
CPC ..... *C25D 3/38* (2013.01); *C23C 18/16* (2013.01); *C23C 18/1653* (2013.01); *C23C 18/2086* (2013.01); *C23C 18/40* (2013.01); *C25D 3/04* (2013.01); *C25D 3/12* (2013.01); *C23C 18/285* (2013.01); *C23C 18/30* (2013.01); *C25D 5/14* (2013.01)

(58) Field of Classification Search
CPC . C23C 18/40; C23C 18/1653; C23C 18/2086; C23C 18/24; C23C 18/285; C23C 18/30; C25D 3/04; C25D 3/12; C25D 3/38; C25D 5/14; C25D 5/43; C25D 5/54; B05D 1/18
USPC ..... 106/1.23, 1.26; 252/519.3; 427/123; 205/169
See application file for complete search history.

(56) References Cited

U.S. PATENT DOCUMENTS

| | | | | |
|---|---|---|---|---|
| 3,930,963 | A | 1/1976 | Polichette et al. | |
| 4,632,852 | A * | 12/1986 | Akahoshi | C23C 18/40 106/1.23 |
| 5,419,926 | A | 5/1995 | Soltys | |
| 5,543,182 | A | 8/1996 | Joshi et al. | |
| 5,645,628 | A | 7/1997 | Endo et al. | |
| 5,795,828 | A | 8/1998 | Endo et al. | |
| 6,331,239 | B1 | 12/2001 | Shirota et al. | |
| 6,805,915 | B2 | 10/2004 | Itabashi et al. | |
| 7,169,216 | B2 | 1/2007 | Itabashi et al. | |
| 7,220,296 | B1 * | 5/2007 | Chowdhury | C23C 18/40 106/1.23 |
| 9,657,226 | B2 * | 5/2017 | Nagamine | C23C 18/24 |
| 2003/0054094 | A1 | 3/2003 | Itabashi et al. | |
| 2005/0079280 | A1 | 4/2005 | Itabashi et al. | |
| 2006/0134318 | A1 | 6/2006 | Hudd et al. | |
| 2007/0079727 | A1 | 4/2007 | Itabashi et al. | |
| 2008/0223253 | A1 * | 9/2008 | Song | C23C 18/40 106/1.23 |

(Continued)

FOREIGN PATENT DOCUMENTS

| | | |
|---|---|---|
| CN | 1745194 A1 | 3/2006 |
| EP | 0 616 053 A1 | 9/1994 |

(Continued)

OTHER PUBLICATIONS

English translation of the Written Opinion of the International Search Authority dated Jan. 13, 2015 for PCT/JP2014/080527; 4 pages.*

(Continued)

*Primary Examiner* — Helene Klemanski

(74) *Attorney, Agent, or Firm* — Westerman, Hattori, Daniels & Adrian, LLP

(57) ABSTRACT

An object of the present invention is to provide a novel conductive film-forming bath comprising an alkaline aqueous solution that can be used to form a film by electroplating on a non-conductive plastic material, the conductive film-forming bath being capable of forming a film by electroplating that has an excellent appearance and that does not suffer from reduced adhesiveness with respect to a non-conductive plastic material. The present invention relates to a conductive film-forming bath comprising an aqueous solution containing a copper compound, a complexing agent, an alkali metal hydroxide, and a water-soluble polymer having a polyoxyalkylene structure.

12 Claims, No Drawings

(56) References Cited

U.S. PATENT DOCUMENTS

| | | | |
|---|---|---|---|
| 2009/0120798 | A1 | 5/2009 | Tai |
| 2010/0003399 | A1 | 1/2010 | Hotta et al. |
| 2010/0155255 | A1* | 6/2010 | Nagao ..... C23C 18/1653 205/184 |
| 2010/0247880 | A1 | 9/2010 | Kano et al. |
| 2012/0058254 | A1 | 3/2012 | Hotta et al. |
| 2015/0322585 | A1 | 11/2015 | Yoshikawa et al. |
| 2016/0273118 | A1 | 9/2016 | Takeuchi et al. |

FOREIGN PATENT DOCUMENTS

| | | | |
|---|---|---|---|
| EP | 0 913 502 | A1 | 5/1999 |
| EP | 0 815 292 | B1 | 1/2000 |
| GB | 1195217 | A | 6/1970 |
| GB | 2 109 013 | A | 5/1983 |
| JP | 61-9578 | A | 1/1986 |
| JP | 03-076599 | B | 12/1991 |
| JP | 05-148662 | A | 6/1993 |
| JP | 05-221637 | A | 8/1993 |
| JP | 08-083796 | A | 3/1996 |
| JP | 09-509219 | A | 9/1997 |
| JP | 2000-144439 | A | 5/2000 |
| JP | 3091583 | B2 | 9/2000 |
| JP | 2003-138381 | A | 5/2003 |
| JP | 2005-200666 | A | 7/2005 |
| JP | 2006-219757 | A | 8/2006 |
| JP | 2006-299366 | A | 11/2006 |
| JP | 4351736 | B2 | 10/2009 |
| JP | 2010-31361 | A | 2/2010 |
| JP | 2010-254971 | A | 11/2010 |
| KR | 20020069154 | A | 8/2002 |
| WO | 98/045505 | A1 | 10/1998 |

OTHER PUBLICATIONS

English translation of JP 2000/144439, May 2000; 18 pages.*
English translation of JP 2003/138381, May 2003; 31 pages.*
English translation of JP 2005/200666, Jul. 2005; 9 pages.*
Supplementary Partial European Search Report (ESR) dated Aug. 3, 2016, issued in European Patent Application No. 13866055.0 (counterpart to U.S. Appl. No. 14/652,199). (9 pages).
Office Action dated Mar. 30, 2017, issued in U.S. Appl. No. 14/652,199. (10 pages).
International Search Report dated Jan. 13, 2015, issued in counterpart International Application No. PCT/JP2014/080527 (1 page).
International Search Report dated Mar. 4, 2014, issued in International Application No. PCT/JP2013/083713 (2 pages).
Written Opinion dated Mar. 4, 2014, issued in International Application No. PCT/JP2013/083713. ( 4 pages).
Non-Final Office Action dated Jun. 22, 2017, issued in U.S. Appl. No. 14/652,199 (10 pages).
Office Action dated Jun. 21, 2017, issued in counterpart Korean Patent Application No. 10-2016-7013814, with English translation. (11 pages).
Extended (supplementary) European Search Report dated May 31, 2017, issued in counterpart European Application No. 14879928.1. (6 pages).
Final Office Action dated Nov. 3, 2017, issued in U.S. Appl. No. 14/652,199. (18 pages).
Advisory Action dated Feb. 5, 2018, issued in U.S. Appl. No. 14/652,199. (2 pages).

* cited by examiner

CONDUCTIVE FILM-FORMING BATH

TECHNICAL FIELD

The present invention relates to a conductive film-forming bath, a method for forming a conductive film, and a method for electroplating a non-conductive plastic material.

BACKGROUND ART

In general, a method that is widely used for electroplating non-conductive plastic moldings to form a decorative film comprises, in succession, degreasing, etching, optionally neutralizing and pre-dipping, then applying a catalyst for electroless copper plating by using a colloidal solution containing a palladium compound and a tin compound, and optionally activating (performing accelerator treatment), followed by conductive film formation (electroless copper plating) and electroplating.

In such a method for electroplating non-conductive plastic moldings, an alkaline aqueous solution has heretofore been used as an electroless copper plating bath to form a conductive film. However, when an alkaline electroless copper plating bath is used to form a conductive film, a target non-conductive plastic easily undergoes hydrolysis; thus, when a film is formed by electroplating on the formed conductive film, sufficient adhesiveness cannot be obtained (Patent Literature (PTL) 1).

CITATION LIST

Patent Literature

PTL 1: JP2010-254971A

SUMMARY OF INVENTION

Technical Problem

The present invention was made in view of the state of the prior art. A primary object of the present invention is to provide a novel conductive film-forming bath comprising an alkaline aqueous solution that can be used to form a film by electroplating on a non-conductive plastic material, the conductive film-forming bath being capable of forming an electroplating film that has an excellent appearance and that does not suffer from reduced adhesiveness with respect to a non-conductive plastic material.

Solution to Problem

The present inventors conducted extensive research to achieve the above object. As a result, the present inventors found the following: when an aqueous solution obtained by adding a water-soluble polymer having a polyoxyalkylene structure to an alkaline aqueous solution containing a copper compound and a complexing agent is used as a conductive film-forming bath, and a film is formed by electroplating on a conductive film that is formed with the use of the bath, it is possible to achieve an excellent appearance for the formed electroplating film and prevent the reduction in adhesiveness with respect to a non-conductive plastic material. The present invention has thus been accomplished.

The present invention has been made through further research based on the above findings.

More specifically, the present invention provides the following conductive film-forming bath, method for forming a conductive film, and method for electroplating a non-conductive plastic material.

Item 1.

A conductive film-forming bath comprising an aqueous solution containing a copper compound, a complexing agent, an alkali metal hydroxide, and a water-soluble polymer having a polyoxyalkylene structure.

Item 2.

The conductive film-forming bath according to Item 1, further comprising a reducing agent.

Item 3.

The conductive film-forming bath according to Item 2, wherein the reducing agent is at least one component selected from the group consisting of carboxyl-containing reducing compounds and reducing saccharides having 6 or more carbon atoms.

Item 4.

The conductive film-forming bath according to any one of Items 1 to 3, further comprising a $C_{2-5}$ aliphatic polyalcohol compound.

Item 5.

The conductive film-forming bath according to any one of Items 1 to 4, wherein the water-soluble polymer having a polyoxyalkylene structure is with a backbone having a repeating structure of a structural unit: an oxyalkylene group represented by Formula (1): —(O-Ak)-, wherein Ak represents alkylene, and wherein the polymer has one or more hydrophilic groups.

Item 6.

The conductive film-forming bath according to any one of Items 1 to 5, wherein the water-soluble polymer having a polyoxyalkylene structure has a number average molecular weight of 300 or more.

Item 7.

A method for forming a conductive film on a non-conductive plastic material, the method comprising bringing a non-conductive plastic material to which a catalyst substance is applied into contact with the conductive film-forming bath of any one of Items 1 to 6.

Item 8.

A method for electroplating a non-conductive plastic material, the method comprising a step of performing electroplating after a conductive film is formed using the conductive film-forming bath by the method of Item 7.

The conductive film-forming bath according to the present invention comprises an aqueous solution containing a copper compound, a complexing agent, an alkali metal hydroxide, and a water-soluble polymer having a polyoxyalkylene structure.

The following describes in detail each component contained in the conductive film-forming bath of the present invention.

(1) Conductive Film-Forming Bath Copper Compound

The copper compound is not limited as long as it is a water-soluble copper compound. For example, copper sulfate, copper chloride, copper carbonate, copper hydroxide, and hydrates thereof, may be used. The copper compound may be used alone, or in an appropriate combination of two or more.

The amount of the copper compound used is preferably about 0.1 to 5 g/L, and more preferably about 0.8 to 1.2 g/L, calculated as copper metal.

The use of an excessively small amount of copper metal results in insufficient formation of a conductive film, and the deposition in the subsequent electroplating step will be unsatisfactory; therefore, an excessively small amount of the copper metal is not preferable.

The use of an excessively large amount of copper metal only requires an increase in the amount of the complexing agent in proportion to the copper concentration, although almost no effect is produced by the increase in the copper concentration; the increase in the copper concentration results in an economic disadvantage and in difficulty in effluent treatment.

Complexing Agent

As a complexing agent, those that are known to be effective with regard to copper ions may be used. Examples of such complexing agents include hydantoin compounds, organic carboxylic acids, and the like.

Examples of hydantoin compounds include hydantoin, 1-methylhydantoin, 1,3-dimethylhydantoin, 5,5-dimethylhydantoin, allantoin, and the like.

Examples of organic carboxylic acids include ethylenediaminetetraacetic acid, glycolic acid, lactic acid, hydracrylic acid, oxybutyric acid, tartronic acid, malic acid, citric acid, tartaric acid, succinic acid, salts thereof, and the like. Examples of salts include water-soluble salts, such as alkali metal salts, alkaline earth metal salts, and ammonium salts.

As the complexing agent, in particular, sodium potassium tartrate (Rochelle salt) is preferably used.

The complexing agent may be used alone, or in an appropriate combination of two or more.

The amount of the complexing agent used is preferably about 2 to 50 g/L, and more preferably about 10 to 40 g/L.

An excessively small amount of the complexing agent provides insufficient complexing power, resulting in lack of ability to dissolve copper; thus, an excessively small amount of the complexing agent is not preferable.

Although an excessively large amount of the complexing agent enhances the ability to dissolve copper, it leads to economic disadvantage and difficulty in effluent treatment, and is thus not preferable.

Alkali Metal Hydroxide

As an alkali metal hydroxide, it is suitable to use sodium hydroxide, potassium hydroxide, lithium hydroxide, and the like, in view of their easy availability, costs, and the like.

These alkali metal hydroxides may be used alone, or in an appropriate combination of two or more.

The amount of the alkali metal hydroxide is preferably about 10 to 80 g/L, and more preferably about 30 to 70 g/L.

If the amount of the alkali metal hydroxide is excessively small, a conductive film is insufficiently formed, and deposition occurs unsatisfactorily over the range of low current density in the subsequent electroplating step. Therefore, the use of an excessively small amount of alkali metal hydroxide is not preferable.

On the other hand, an excessively large amount of the alkali metal hydroxide is not preferable because it decreases the ability to dissolve copper as the hydroxide concentration increases, lowering the stability of the conductive film-forming bath.

Water-Soluble Polymer Having a Polyoxyalkylene Structure

The water-soluble polymer having a polyoxyalkylene structure is not particularly limited, as long as it is a polymer having a polyoxyalkylene structural moiety as a backbone, and having one or more hydrophilic groups. The polyoxyalkylene structure as used herein refers to a repeating structure of a structural unit: an oxyalkylene group represented by Formula (1): —(O-Ak)-, wherein Ak represents alkylene. The repeating number of the oxyalkylene structure represented by Formula (1) above is not particularly limited as long as the number average molecular weight is within the range mentioned below. The repeating number is generally preferably 4 or more.

In Formula (1) above, the alkylene represented by Ak is preferably $C_{1-2}$ alkylene, and more preferably $C_{2-4}$ alkylene. The alkylene may be a straight or branched chain.

Specific examples of the alkylene include methylene, ethylene, propylene, butylene, and the like. Of these, ethylene and propylene are preferable to obtain a polymer with excellent water solubility.

In the repeating structure of a structural unit: an oxyalkylene group represented by Formula (1): —(O-Ak)-, the alkylene represented by Ak may all be identical in each structural unit, or may be of two or more different types. When the polyoxyalkylene structure contains two or more types of oxyalkylene groups, the bonding structure between the oxyalkylene groups of different types is not limited; the polymer may be any of block, random, or alternating polymers.

When the repeating unit represented by Formula (1) above: —(O-Ak)- represents, for example, an oxypropylene group represented by Formula (3): —(O—CH($CH_3$)$CH_2$)—, the polymer has optical isomers; the stereoregularities may be any of isotactic, syndiotactic, or atactic.

The hydrophilic group contained in the water-soluble polymer having a polyoxyalkylene structure is not particularly limited as long as water solubility is sufficiently imparted, and may be any of an anionic, cationic, or nonionic hydrophilic group. Specific examples of such a hydrophilic group include carboxyl, sulfonic acid, sulfuric acid ester, phosphonic acid, phosphoric acid, and like anionic groups and salts thereof; hydroxyl, amino, and like nonionic groups; ammonium, phosphonium, ana like cationic groups; and the like. Among these, salts of anionic groups may be, for example, alkali metal salts, alkaline earth metal salts, ammonium salts, organic ammonium salts, and the like.

The number of hydrophilic groups is not particularly limited as long as water solubility is sufficiently imparted to the water-soluble polymer having a polyoxyalkylene structure. The hydrophilic group-binding site is also not particularly limited. The hydrophilic group may be bonded to any site, such as an end or a side chain, of the water-soluble polymer. A specific number of hydrophilic groups and a specific binding site are not specifically limited as long as the water-soluble polymer to which the hydrophilic group is bonded is dissolved in the conductive film-forming bath of the present invention at a concentration within the range mentioned below.

The water-soluble polymer having a polyoxyalkylene structure may contain one or more substituents or one or more other atoms, in addition to the hydrophilic group above. Such substituents and atoms are not particularly limited as long as they do not interfere with the water solubility of the polymer, and may be, for example, hydrogen, alkyl, alkenyl, aryl, halogen, and the like.

Specific examples of the water-soluble polymer having a polyoxyalkylene structure usable in the present invention include polyalkylene glycol compounds, such as polyethylene glycol, polypropylene glycol, polyoxyethylene polyoxypropylene glycol, polyoxyethylene polyoxybutylene glycol, and polyoxypropylene polyoxybutylene glycol;

polyoxyalkylene alkyl ether compounds, such as polyoxyethylene octyl ether, polyoxyethylene decyl ether, polyoxyethylene lauryl ether, polyoxypropylene butyl ether, polyoxyethylene tridecyl ether, polyoxyethylene myristyl ether, polyoxyethylene polyoxypropylene octyl ether, polyoxyethylene polyoxypropylene butyl ether, polyoxyethylene polyoxypropylene decyl ether, polyoxyethylene polyoxypropylene lauryl ether, polyoxyethylene polyoxypropylene tridecyl ether, polyoxyethylene polyoxypropylene myristyl ether, and polyoxyethylene styrenated phenyl ether; compounds having a polyoxyalkylene structure and one amino group, such as Jeffamine M-600 and M-2070 (both of which are registered trademarks);

compounds having a polyoxyalkylene structure and two amino groups, such as Jeffamine D-400 (average molecular weight (430), D-2000, D-4000, ED-600, ED-900, ED-2003, XTJ-542, XTJ-533, and XTJ-536 (all of which are registered trademarks);

compounds having a polyoxyalkylene structure and three amino groups, such as Jeffamine T-403, T-3000, and T-5000 (all of which are registered trademarks);

sulfonic acid-containing compounds having a polyoxyalkylene structure, such as ammonium polyoxyethylene oleyl cetyl ether sulfate, ammonium polyoxyethylene lauryl ether sulfate, and ammonium polyoxyethylene styrenated phenyl ether sulfate;

carboxylic acid group-containing compounds having a polyoxyalkylene structure, such as sodium polyoxyethylene lauryl ether acetate;

carboxylic acid- and sulfonic acid-containing compounds having a polyoxyalkylene structure, such as disodium lauryl polyoxyethylene sulfosuccinate;

phosphoric acid-containing compounds having a polyoxyalkylene structure, such as polyoxyethylene alkyl ether phosphoric acid ester; and the like.

Among these, particularly preferable compounds are polyethylene glycol, polypropylene glycol, polyoxyethylene polyoxypropylene glycol, polyoxyethylene lauryl ether, polyoxypropylene butyl ether, polyoxyethylene polyoxypropylene butyl ether, polyoxyethylene polyoxypropylene monoamine, polyoxyethylene polyoxypropylene diamine, ammonium polyoxyethylene oleyl cetyl ether sulfate, ammonium polyoxyethylene lauryl ether sulfate, ammonium polyoxyethylene styrenated phenyl ether sulfate, disodium lauryl polyoxyethylene sulfosuccinate, sodium polyoxyethylene lauryl ether acetate, polyoxyethylene alkyl ether phosphoric acid ester, polyoxyethylene styrenated phenyl ether, and the like.

The water-soluble polymer having a polyoxyalkylene structure may be used alone or in an appropriate combination of two or more.

The water-soluble polymer having a polyoxyalkylene structure may have a number average molecular weight of 300 or more, preferably 500 to 50,000, still more preferably 600 to 20,000, and particularly preferably 1,000 to 20,000. When the number average molecular weight is excessively small, it is impossible to sufficiently achieve the effect of disproving the adhesiveness of a plating film with respect to a non-conducting material; therefore, an excessively small number average molecular weight is not preferable.

The amount of the water-soluble polymer having a polyoxyalkylene structure used is preferably about 0.00001 to 100 g/L, more preferably about 0.001 to 50 g/L, and particularly preferably about 0.01 to 10 g/L. The use of an excessively small amount of the polymer is not preferable because it is impossible to sufficiently achieve the effect of improving the adhesiveness of a plating film with respect to a non-conducting material. In contrast, the use of an excessively large amount of the water-soluble polymer having a polyoxyalkylene structure is economically disadvantageous, and is not preferable also in terms of the effluent treatment.

Reducing Agent

In the conductive film-forming bath of the present invention, the aqueous solution containing the copper compound described above, the complexing agent described above, the alkali metal hydroxide described above, and the water-soluble polymer having a polyoxyalkylene structure described above, may further optionally contain a reducing agent.

The use of a reducing agent makes it possible to improve the conductive film deposition rate to efficiently form a conductive film.

As a reducing agent, those that are capable of reducing copper ions, and that have been incorporated in various electroless plating solutions may be used. Specific examples thereof include formaldehyde, paraformaldehyde, dimethylamine borane, glyoxylic acid, boronhydride salts, reducing saccharides having 6 or more carbon atoms, carboxyl-containing reducing compounds, and the like. The reducing agent may be used alone or in an appropriate combination of two or more.

Of the above reducing agents, examples of the boronhydride salts include sodium borohydride, potassium borohydride, lithium borohydride, and the like.

Examples of the carboxyl-containing reducing compound include carboxylic acids having reducing properties, dicarboxylic acids having reducing properties, salts thereof, and the like. As the carboxylic acid having reducing properties, it is possible to use, for example, formic acid, glyoxylic acid, salts thereof, and the like. As the dicarboxylic acid having reducing properties, it is possible to use oxalic acid, maleic acids, salts thereof, and the like. Examples of the salts include alkali metal salts, salts containing a —$NH_4$ group (ammonium salts), and the like. Examples of alkali metals include lithium, sodium, potassium, and the like.

The reducing saccharide having 6 or more carbon atoms is not particularly limited, as long as it has 6 or more carbon atoms and reducing properties, and known reducing saccharides may be used. Examples of known reducing saccharides include monosaccharides, such as glucose; disaccharides, such as sucrose; polysaccharides, such as cellulose; sugar alcohols, such as sorbitol and mannitol; sugar acids, such as ascorbic acid; lactones, such as gluconolactone; and the like. In addition, amino sugar, deoxy sugar, and the like, may also be used. The reducing saccharide having 6 or more carbon atoms preferably has about 6 to 12 carbon atoms.

When one or more types of compounds are incorporated as a reducing agent, the total amount of the reducing agent contained is preferably about 0.1 to 100 g/L, and more preferably about 0.5 to 50 g/L.

Of the reducing agents mentioned above, carboxyl-containing reducing compounds and reducing saccharides having 6 or more carbon atoms have a relatively low reducing power. In the present invention, the use of at least one member selected from these components as a reducing agent makes it possible to use a hydantoin compound or organic carboxylic acid compound that has relatively weak complexing power as a complexing agent, without lowering the stability of the conductive film-forming bath. In this manner, sufficient deposition properties are maintained while effluent treatment is easily performed.

Aliphatic Polyalcohol

The conductive film-forming bath of the present invention may further optionally contain an aliphatic polyalcohol.

In particular, when at least one component is selected from the group consisting of carboxyl-containing reducing compounds and reducing saccharides having 6 or more carbon atoms and used as a reducing agent, the incorporation of an aliphatic polyalcohol makes it possible to form a uniform conductive film with no bridge deposits and thus to improve the appearance of a finally formed electroplating film.

As an aliphatic polyalcohol, a $C_{2-5}$ straight or branched chain aliphatic polyalcohol having two or more hydroxy groups may be used. The carbon chain in the aliphatic polyalcohol may contain one or more oxygen atoms.

The number of hydroxy groups contained in the aliphatic polyalcohol is not limited as long as it is 2 or more, preferably 2 to 4, more preferably 2 or 3, and particularly preferably 2.

Specific examples of the aliphatic polyalcohol include ethylene glycol, 1,2-propanediol, 1,2-butanediol, 1,2-pentanediol, glycerin, erythritol, xylitol, 1,2,4-butanetriol, diethylene glycol, 1,3-propanediol, 1,4-butanediol, 1,5-pentanediol, 2,2-dimethyl-1,3-propanediol, and the like.

These aliphatic polyalcohol compounds may be used alone or in an appropriate combination of two or more.

The amount of the aliphatic polyalcohol compound used is preferably about 1 to 500 g/L, and more preferably about 1 to 200 g/L.

As an aliphatic polyalcohol contained in the conductive film-forming bath of the present invention, it is preferable to use, in particular, an aliphatic polyalcohol having 2 or fewer carbon atoms between two hydroxy groups. For example, it is preferable to use ethylene glycol, 1,2-propanediol, glycerin, erythritol, or xylitol, and it is particularly preferable to use ethylene glycol.

The amount of an aliphatic polyalcohol having 2 or fewer carbon atoms between two hydroxy groups, when used, is about 1 to 50 g/L, which makes it possible to form a film having excellent conductivity.

When an aliphatic polyalcohol having 3 or more carbon atoms between two hydroxy groups is used, the amount thereof is preferably about 50 g/L or more within the above amount range.

Examples of aliphatic polyalcohols having 3 or more carbon atoms between two hydroxy groups include 1,2,4-butanetriol, diethylene glycol, 1,3-propanediol, 1,4-butanediol, 1,5-pentanediol, 2,2-dimethyl-1,3-propanediol, and the like.

(2) Method for Forming a Conductive Film

A conductive film may be formed on a non-conductive plastic material by bringing the non-conductive plastic material to which a catalyst substance is applied into contact with the conductive film-forming bath of the present invention.

The following specifically describes the method for forming a conductive film.

Non-Conductive Plastic Material

Examples of non-conductive plastic materials include, but are not limited to, various large plastic materials that have recently been widely used in the automobile industry, and the like.

Examples of such large plastic materials include various plastic moldings, such as front grilles, emblems, and other automotive parts; exterior components of electronic devices; knobs and other parts to be plated for decoration; and materials to be plated to provide corrosion resistance or to add a function.

The qualify of plastic materials is not particularly limited, and various plastic materials known until now may be used as a target for treatment.

Examples of plastic materials include general-purpose plastics widely used until now for chemical plating, such as polycarbonate (PC) resins, polyester resins, and acrylonitrile-butadiene-styrene (ABS) resins; general-purpose engineering plastics having heat resistance at a temperature of 150° C. or lower, such as polyamides (nylon PA), polyacetals (POM), polycarbonates (PC), modified polyphenylene ethers (PPE), polybutylene terephthalates (PBT), and the like; super engineering plastics having heat resistance at a temperature higher than 200° C., such as polyphenylene sulfides (PPS), polyether sulfones (PES), polyether imides (PEI), polyether ether ketones (PEEK), polyimides (PI), liquid crystal polymers (LCP), and the like; polymer alloys, such as PC/ABS; and the like.

The use of the conductive film-forming bath of the present invention makes it possible to form a conductive film having excellent properties as an electroplating base layer that is effectively used to form an electroplating film with excellent adhesiveness with respect to the plastic material mentioned above. The use of the conductive film-forming bath of the present invention enables the formation of a conductive film that has excellent properties. On this conductive film, it is possible to form an electroplating film with excellent adhesiveness with respect to, in particular, PC, polyester, and polymer alloys containing these resins (e.g., a PC/ABS polymer alloy), which are susceptible to hydrolysis with alkali.

Pretreatment Step

In the method for forming a conductive film according to the present invention, a pretreatment is first conducted in the conventional manner. Specifically, the surface of a substrate to be treated is cleaned to remove extraneous matter, such as fingerprints, fats and oils, and other organic substances, as well as dust clinging by static electricity. Degreasing and the like are conducted in a conventional manner using a conventional degreasing agent, such as an alkaline degreasing agent, as a treatment solution.

Next, the surface of the substrate is optionally etched.

This process selectively dissolves the surface of a resin substrate to achieve an anchor effect. This treatment improves the adhesiveness, appearance, etc., of the resulting conductive film.

Etching may be carried out by using conventional methods. For example, the substrate may be immersed in a moderately heated mixed solution of chromic acid and sulfuric acid.

For example, when an ABS resin is used as a substrate to be treated, the etching treatment allows the polybutadiene, i.e., a constituent component of ABS resin, to be oxidized by chromic acid and eluted to give anchor pores of about 1 to 2 μm in pore size to the surface of the resin, while the polybutadiene is caused to undergo oxidative decomposition, producing a polar group such as a carbonyl group. Consequently, a catalyst, such as a tin-palladium mixed colloidal solution, is easily adsorbed in the subsequent step.

When substrates such as general-purpose engineering plastic or super engineering plastic are used, it is often difficult to perform etching; therefore, it is preferable to perform pre-etching, as required, in a conventional manner before the etching treatment.

The pre-etching treatment uses an organic solvent to swell a skin layer or a crystal-oriented layer on the surface of the resin substrate. The pre-etching can be performed generally using a solvent of high polarity, such as dimethyl sulfoxide. This pre-etching treatment enhances the etching effect.

For resins containing inorganic materials, glass fibers, and the like, as well, a suitable etching method may be selected in accordance with conventional methods.

Thereafter, washing is performed to remove the etching solution, such as chromic acid, remaining on the resin surface.

In the washing, the use of a dilute hydrochloric acid solution or a solution containing a reducing agent, such as sodium bisulfite makes it easy to remove the chromic acid remaining on the resin surface.

Catalyst Application Step

Next, a catalyst is applied to the substrate obtained in the pretreatment step.

The type of catalyst is not particularly limited, and various catalysts known for electroless plating may be used.

For example, known compositions that are used for noble metal catalyst application and that contain silver, palladium, gold, ruthenium, copper, nickel, platinum, and the like, as a catalyst component, may be used.

The specific type of the composition for catalyst application and the specific process for catalyst application are not particularly limited, and may be suitably selected from known compositions and known processes for catalyst application.

For example, the following processes may be used for palladium catalyst application:

a process comprising immersing a substrate to be treated in a sensitizer solution (a hydrochloric acid solution of tin(II) chloride), and then immersing the resulting substrate in an activator solution (a hydrochloric acid solution of palladium chloride) (a sensitizer-activator process);

a process comprising immersing a substrate to be treated in a tin-palladium mixed colloidal solution to apply a catalyst to the substrate, and then immersing the resulting substrate in an accelerator solution that is an acidic solution, such as sulfuric acid, to dissolve excess tin ions so as to improve the catalytic activity (a catalyst-accelerator process); and the like. The application of a catalyst can also be achieved by performing only a step of immersion in a tin-palladium mixed colloidal solution.

In the conductive film-forming bath of the present invention, it is preferable to use a tin-palladium mixed colloidal solution, which easily causes deposition to uniformly form a plating film on a resin molding. In particular, when the conductive film-forming bath of the present invention is free of a reducing agent, the use of a tin-palladium mixed colloidal solution increases the amount of tin colloid remaining on the surface of a resin molding, which makes it easy to form a conductive film by displacement deposition.

As the tin-palladium mixed colloidal solution, a generally used acidic colloidal aqueous solution mixture containing palladium chloride and stannous chloride may be used. For example, a colloidal solution mixture may be used containing palladium chloride in an amount of about 0.05 to 0.6 g/L, stannous chloride in an amount of about 1 to 50 g/L, and 35% hydrochloric acid in an amount of about 100 to 400 mL/L.

The conditions for immersing a substrate to be treated in the tin-palladium mixed colloidal solution are not particularly limited. The substrate may generally be immersed in a mixed colloidal solution that has a temperature adjusted to about 10 to 80° C., and preferably about 20 to 40° C.

The time for immersion is suitably adjusted according to, for example, the type of conductive film-forming bath of the present invention. It is generally about 2 to 10 minutes.

Conductive Film Formation Step

Next, a conductive film is formed by bringing a non-conductive plastic material to which a catalyst substance is applied into contact with the conductive film-forming bath of the present invention.

A method for forming a conductive film by bringing a non-conductive plastic material to which a catalyst is applied into contact with the conductive film-forming bath of the present invention comprises, for example, immersing a non-conductive plastic material to which a catalyst is applied in a conductive film-forming bath. It is possible for this method to efficiently form a conductive film.

The conductive film-forming bath of the present invention has a pH of preferably about 10 to 14, and more preferably about 11.5 to 13.5. An excessively low pH prevents the reduction reaction from smoothly proceeding and possibly induces, for example, decomposition of the reducing agent, which causes unsatisfactory deposition of the conductive film and decomposition of the conductive film-forming bath. Therefore, an excessively low pH is not preferable. On the other hand, an excessively high pH tends to lower the stability of the conductive film-forming bath, and is not preferable.

The temperature of the bath to form a conductive film varies according to the specific composition, etc., of the conductive film-forming bath. It is generally preferably about 30° C. or more, more preferably about 40 to 80° C., and particularly preferably about 50 to 70° C. If the liquid temperature of the conductive film-forming bath is too low, the film deposition reaction proceeds slowly, which easily results in a failure in deposition of a film or creation of inferior appearance. In contrast, an increase in the liquid temperature of the conductive film-forming bath reduces the surface resistance after the formation of a conductive film, thus achieving a plated film with an excellent appearance. However, if the conductive film-forming bath has an excessively high liquid temperature, extensive evaporation of the conductive film-forming bath takes place, which makes it difficult to maintain the composition of the plating solution within the predetermined range, and the conductive film-forming bath is easily decomposed; thus, an excessively high liquid temperature is not preferable.

The time for which the conductive film-forming bath is in contact is not particularly limited, and may be set as required for complete formation of the conductive film. The time may be appropriately set according to the surface state of the conductive film. If the contact time is too short, the supply of a conductive film onto the subject surface will be insufficient, making it impossible to fully form a conductive film.

When a conductive film is formed by bringing a non-conductive plastic material to which a catalyst is applied into contact with the conductive film-forming bath of the present invention, the time for immersion is preferably about 1 to 10 minutes, and particularly preferably about 3 to 5 minutes.

As described below, when at least one component selected from the group consisting of carboxyl-containing reducing compounds and reducing saccharides having 6 or more carbon atoms is used as a reducing agent, together with the use of an aliphatic polyalcohol, a conductive film mainly consisting of copper oxide is formed. In this case, when the formed film is brought into contact with an acidic aqueous solution, the copper oxide undergoes a disproportionation reaction, thereby forming a dense film containing metal copper.

It is preferable to use, in particular, a sulfuric acid-containing aqueous solution as the acidic aqueous solution. For example, an aqueous solution having a sulfuric acid concentration of about 20 to 120 g/L may be used.

After the formation of a film that mainly consists of copper oxide, the film is brought into contact with an acidic aqueous solution to form a dense film containing metal copper; in the subsequent step, however, if the film is brought into contact with a sulfuric acid-containing acidic plating solution, such as a copper sulfate plating solution, the step for immersing the film into an acidic aqueous solution can be omitted.

This dense film containing metal copper has improved conductivity and improved acid resistance. Thus, in the electroplating step, the conductive film is not damaged, making it possible to form an electroplating film having a uniform appearance with excellent adhesiveness.

When a conductive film-forming bath is used that contains an aliphatic polyalcohol and a reducing agent comprising at least one component selected from the group consisting of carboxyl-containing reducing compounds and reducing saccharides having 6 or more carbon atoms, the conductive film-forming bath is preferably used in a state in which the bath contains an increased amount of dissolved oxygen when being brought into contact with a non-conductive plastic material. This makes it possible to form a thicker conductive film that mainly consists of copper oxide, thereby further improving the conductivity of the conductive film.

A means for achieving the state in which the bath contains an increased amount of dissolved oxygen is not particularly limited, and any method may be used, such as a method of supplying oxygen-containing gas bubbles to the conductive film-forming bath or a method of adding an oxidizing agent to the conductive film-forming bath.

The state in which the bath contains an increased amount of dissolved oxygen refers not only to the state after the amount of dissolved oxygen has been increased by supplying oxygen-containing gas bubbles or adding an oxidizing agent to the conductive film-forming bath, but also the state in which the amount of dissolved oxygen is being increased by continuously supplying oxygen-containing gas bubbles or by continuously adding an oxidizing agent to the conductive film-forming bath.

Oxygen or air may be used as the oxygen-containing gas. Oxygen or air may include gases, such as nitrogen and rare gas, in addition to oxygen.

The oxidizing agent is not particularly limited, and a known compound that can increase the amount of dissolved oxygen may be used. For example, the addition of sodium persulfate, hydrogen peroxide solution, or the like, increases the amount of dissolved oxygen in the conductive film-forming bath.

The amount of oxidizing agent added is preferably about 0.1 to 5 g/L, with respect to the conductive film-forming bath.

Conductive Film

A film having excellent conductivity is formed on the surface of a non-conductive plastic material by performing the conductive film formation step described above. When the formed conductive film, which has excellent adhesiveness with respect to a non-conductive plastic material used as a substrate to be plated, is subsequently subjected to electroplating treatment, it is possible to form an electroplating film having excellent adhesiveness. In particular, even when non-electroconductive plastics are plastics susceptible to hydrolysis with an aqueous alkaline solution, such as polycarbonate (PC) resin, polyester resin, and PC/ABS polymer alloy, the use of the conductive film-forming bath of the present invention makes it possible to form a conductive film having excellent adhesiveness.

The formed conductive film mainly consists of metal copper. When at least one component is used that is selected from the group consisting of carboxyl-containing reducing compounds and reducing saccharides having 6 or more carbon atoms, as a reducing agent, together with an aliphatic polyalcohol, in the conductive film-forming bath, a conductive film that mainly consists of copper oxide is formed. In this case, as described above, a dense film containing metal copper may be formed by bringing the formed film into contact with an acidic aqueous solution or an acidic electroplating solution. This film is a uniform film with no bridge deposits and has excellent conductivity, as well as excellent acid resistance. When electroplating is performed on this film, it is possible to form an electroplating film having, in particular, excellent adhesiveness and appearance.

Electroplating Step

After the formation of a conductive film by performing the above step, the substrate on which the conductive film is formed is subjected to electroplating in accordance with known methods.

The type of electroplating bath is not particularly limited, and any electroplating bath known until now may be used. The plating conditions may also be set in accordance with known methods.

As one example of electroplating, the following describes in detail an electroplating method for a decorating purpose, successively comprising copper plating, nickel plating, and chromium plating.

For copper plating, for example, a known copper sulfate plating bath may be used.

For example, a plating bath usable in the present invention is obtained by adding a known brightener to an aqueous solution containing about 100 to 250 g/L of copper sulfate, about 20 to 120 g/L of sulfuric acid, and about 20 to 70 ppm of chlorine ions. The copper sulfate plating conditions may be the same as usual. For example, plating may be performed at a liquid temperature of about room temperature and a current density of about 3 $A/dm^2$ until a film with the predetermined film thickness is obtained.

The conductive film obtained by using the conductive film-forming bath of the present invention has a high acid resistance; therefore, even when the film is immersed in the electroplating step in a strongly acidic plating solution, such as a copper sulfate plating solution, the film is not damaged, and a decorative plating film having uniform and excellent appearance is formed.

For nickel plating, a known nickel plating bath, such as an ordinary Watts bath, may be used. Specifically, a usable plating bath may be prepared by adding a commercially available brightener for nickel plating baths to an aqueous solution containing about 200 to 350 g/L of nickel sulfate, about 30 to 80 g/L of nickel chloride, and about 20 to 60 g/L of boric acid. The plating conditions may be the same as usual. For example, plating may be performed at a liquid temperature of about 55 to 60° C. and at a current density of about 3 A/dm$^2$ until a film with the predetermined film thickness is obtained.

For chromium plating, a known chromium plating bath, such as a usual Sargent bath, may be used. Specifically, an aqueous solution containing about 200 to 300 g/L of chromic anhydride and about 2 to 5 g/L of sulfuric acid may be used. The plating may be performed under the conditions of a liquid temperature of about 45° C. and a current density of about 20 A/dm$^2$ until a film with the predetermined film thickness is obtained.

Advantageous Effects of Invention

The use of the conductive film-forming bath of the present invention makes it possible to form a uniform conductive film on a non-conductive plastic material. The formed conductive film has excellent conductivity, as well as excellent adhesiveness with respect to a non-conductive plastic material. When electroplating is performed on this film, it is possible to form an electroplating film having excellent adhesiveness and excellent appearance. In particular, the conductive film-forming bath of the present invention is highly useful as it is capable of forming a uniform conductive film with excellent adhesiveness even with respect to plastic moldings comprising polycarbonate, polyester, and the like, which are susceptible to hydrolysis with an aqueous alkaline solution.

DESCRIPTION OF EMBODIMENTS

The present invention is described in detail below with reference to Examples. However, the present, invention is not limited to these Examples.

EXAMPLES

Example 1

A flat plate made of a PC/ABS polymer alloy (Iupilon PL-2010, produced by Mitsubishi Engineering-Plastics Corporation) measuring 100 mm×40 mm×3 mm and having a surface area of about 1 dm$^2$ was used as a substrate to be treated.

A jig for use in plating operations had two contact portions for contact with the substrate to be treated, the two contact portions being spaced 11 cm apart. The contact portions were constructed from stainless steel rods with a diameter of 2 mm. The portion other than the contact portions was coated with a vinyl chloride sol by baking. The following steps (1) to (9) were sequentially performed to form a film by electroplating.

(1) Degreasing Treatment

First, the substrate to be treated was set in the jig, which was immersed at 50° C. for 5 minutes in a solution of an alkaline degreasing agent (Ace Clean A-220, 50 g/L aqueous solution, produced by Okuno Chemical Industries Co., Ltd.), and washed with water.

(2) Etching Treatment

Next, the resulting substrate was immersed at 67° C. for 10 minutes in an etching solution comprising an aqueous solution containing 400 g/L of chromic anhydride and 400 g/L of sulfuric acid to give a rough surface to the resin substrate.

(3) Neutralizing Process

Thereafter, the resulting substrate was washed with water and immersed at room temperature for 60 seconds in an aqueous solution of 15 mL/L of CRP conditioner 551M (a resin surface control agent), whose pH had been adjusted to 7 with sodium hydroxide.

(4) Pre-Dipping Treatment

Then, pre-dipping was performed at room temperature for 1 minute by dipping the substrate into an aqueous solution containing 250 mL/L of 35% hydrochloric acid.

(5) Catalyzing Treatment

The substrate was then immersed at 35° C. for 6 minutes in a colloidal solution (pH: 1 or less) containing 83.3 mg/L of palladium chloride (50 mg/L as Pd), 8.6 g/L of stannous chloride (4.5 g/L as Sn), and 250 mL/L of 35% hydrochloric acid to cause a catalyst to uniformly adhere to the substrate.

(6) Conductive Film Formation Treatment

Thereafter, the substrate was sufficiently washed with water to form a conductive film. For conductive film-forming baths, aqueous solutions (present invention baths 1 to 28) were used that were obtained by adding the water-soluble polymer having a polyoxyalkylene structure shown in Tables 1 to 4 below to an aqueous solution (basic bath) that contained 4 g/L of copper sulfate pentahydrate, 20 g/L of Rochelle salt, and 60 g/L of sodium hydroxide (hereinafter referred to as "basic bath A"). The substrate was immersed in each of the conductive film-forming baths for 30 minutes at 60° C. to form a conductive film.

For a comparative test, basic bath A to which a water-soluble polymer was not added (comparative bath 1) and basic baths A to which the water-soluble compound shown in Table 3 below was added (comparative baths 2 to 5) were used as conductive film-forming baths, and conductive films were formed in the same manner as described above.

(7) Copper Sulfate Plating Treatment

Then, the substrate was sufficiently washed with water and subjected to a subsequent copper electroplating step while held in the same jig. A copper electroplating bath was prepared by adding as a brightener 5 mL/L of Top Lucina 2000MU and 0.5 mL/L of Top Lucina 2000A (both produced by Okuno Chemical Industries Co., Ltd.) to an aqueous solution containing 50 g/L of copper sulfate-5$H_2O$, 50 g/L of sulfuric acid, and 50 mg/L of chlorine ions. Using this bath, a copper electroplating operation was performed at a liquid temperature of 25° C. and a current density of 3 A/dm$^2$ for 5 minutes using a phosphorus-containing copper sheet as an anode and the substrate as a cathode while applying mild air agitation.

(8) Nickel Plating Treatment

Thereafter, the substrate was washed with water, immersed at 25° C. for 1 minute in 50 g/L of TOP SUN (produced by Okuno Chemical Industries Co., Ltd.) as an activating agent, and sufficiently washed with water. Subsequently, a plating solution was prepared by adding as a brightener 20 mL/L of KAI ACNA B-1 and 1 mL/L of KAI ACNA B-2 (both produced by Okuno Chemical Industries Co., Ltd.) to an aqueous solution containing 280 g/L of nickel sulfate, 50 g/L of nickel chloride, and 40 g/L of boric acid. Using this solution as a nickel electroplating solution, a nickel electroplating operation was performed at a liquid temperature of 55° C. and a current density of 3 A/dm$^2$ for 20 minutes.

(9) Chromium Plating Treatment

Thereafter, the substrate was washed with water. Then, an aqueous solution containing 250 g/L of chromic anhydride and 1 g/L of sulfuric acid was used as a chromium plating solution to perform a chromium plating operation at a liquid temperature of 40° C. and a current density of 12 A/dm$^2$ for 3 minutes using a lead sheet as an anode and the substrate as a cathode.

Evaluation of Adhesiveness

Each sample in which a plating film was formed by the method described above was evaluated for the adhesiveness of each of the formed plating films by using the following method. Tables 1 to 4 also show the results.

First, each sample was allowed to stand at −30° C. for 60 minutes, at room temperature for 30 minutes, at 70° C. for 60 minutes, and at room temperature for 30 minutes. This process was defined as one cycle, and three cycles were repeated. Thereafter, blistering of the plating film was visually observed, and the adhesiveness of the plating film was evaluated according to the following criteria.

A: No blistering occurred in the plating film.
B: Blistering occurred in 0 to 10% of the plating area.
C: Blistering occurred in 10 to 80% of the plating area.
D: Blistering occurred in 80 to 100% of the plating area.

TABLE 1

| | Water-soluble polymer | | | | |
|---|---|---|---|---|---|
| Conductive film-forming bath | Type | Number average molecular weight | Polymer number | Amount added | Adhesiveness |
| Present invention bath 1 | Polyethylene glycol (PEG #2000/NOF Corporation) | 2000 | Polymer 1 | 0.1 g/L | A |
| Present invention bath 2 | Polypropylene glycol (Polypropylene glycol, diol type, 700/Wako Pure Chemical Industries, Ltd.) | 700 | Polymer 2 | 0.1 g/L | A |
| Present invention bath 3 | Polyoxyethylene polyoxypropylene glycol (Newpol PE-75/Sanyo Chemical Industries, Ltd.) | 1420 | Polymer 3 | 0.1 g/L | A |
| Present invention bath 4 | Polyoxyethylene lauryl ether (Polyoxyethylene (23) lauryl ether/Wako Pure Chemical Industries, Ltd.) | 1200 | Polymer 4 | 0.1 g/L | A |
| Present invention bath 5 | Polyoxypropylene butyl ether (Newpol LB-285/Sanyo Chemical Industries, Ltd.) | 1200 | Polymer 5 | 0.1 g/L | A |
| Present invention bath 6 | Polyoxyethylene polyoxypropylene butyl ether (Newpol 50HB-280/Sanyo Chemical Industries, Ltd.) | 970 | Polymer 6 | 0.1 g/L | A |
| Present invention bath 7 | Polyoxyethylene polyoxypropylene monoamine (JEFFAMINE M-1000/HUNTSMAN) | 1000 | Polymer 7 | 0.1 g/L | A |
| Comparative bath 1 | Not added | — | | — | D |

TABLE 2

| Conductive film-forming bath | Water-soluble polymer: Type | Polymer number | Amount added | Adhesiveness |
|---|---|---|---|---|
| Present invention bath 8 | Ammonium polyoxyethylene oleyl cetyl ether sulfate (Hitenol 18E/Dai-Ichi Kogyo Seiyaku Co., Ltd.) | Polymer 8 | 0.1 g/L | A |
| Present invention bath 9 | Ammonium polyoxyethylene lauryl ether sulfate (Hitenol LA-16/Dai-Ichi Kogyo Seiyaku Co., Ltd.) | Polymer 9 | 0.1 g/L | A |
| Present invention bath 10 | Ammonium polyoxyethylene styrenated phenyl ether sulfate (Hitenol NF-17/Dai-Ichi Kogyo Seiyaku Co., Ltd.) | Polymer 10 | 0.1 g/L | A |
| Present invention bath 11 | Disodium lauryl polyoxyethylene sulfosuccinate (Neo-Hitenol L-30/Dai-Ichi Kogyo Seiyaku Co., Ltd.) | Polymer 11 | 0.1 g/L | A |
| Present invention bath 12 | Sodium polyoxyethylene lauryl ether acetate (Neo-Hitenol ECL-45/Dai-Ichi Kogyo Seiyaku Co., Ltd.) | Polymer 12 | 0.1 g/L | A |
| Present invention bath 13 | Polyoxyethylene alkyl(C8)ether phosphoric acid ester (Plysurf A208F/Dai-Ichi Kogyo Seiyaku Co., Ltd.) | Polymer 13 | 0.1 g/L | A |
| Present invention bath 14 | Polyoxyethylene styrenated phenyl ether (Noigen EA-157/Dai-Ichi Kogyo Seiyaku Co., Ltd.) | Polymer 14 | 0.1 g/L | A |

TABLE 3

| Conductive film-forming bath | Water-soluble polymer: Type | Number average molecular weight | Polymer number | Amount added | Adhesiveness |
|---|---|---|---|---|---|
| Present invention bath 15 | Polyethylene glycol (PEG #300/NOF Corporation) | 300 | Polymer 15 | 0.1 g/L | B |
| Present invention bath 16 | Polyethylene glycol (PEG #600/NOF Corporation) | 600 | Polymer 16 | 0.1 g/L | A |
| Present invention bath 17 | Polyethylene glycol (PEG #1000/NOF Corporation) | 1000 | Polymer 17 | 0.1 g/L | A |
| Present invention bath 18 | Polyethylene glycol (PEG #2000/NOF Corporation) | 2000 | Polymer | 0.1 g/L | A |
| Present invention bath 19 | Polypropylene glycol (Polypropylene glycol 8000/Wako Pure Chemical Industries, Ltd.) | 8000 | Polymer 19 | 0.1 g/L | A |
| Present invention bath 20 | Polyethylene glycol (PEG #2000/NOF Corporation) | 20000 | Polymer 20 | 0.1 g/L | A |
| Comparative bath 2 | Ethylene glycol | 62 | — | 0.1 g/L | D |
| Comparative bath 3 | Diethylene glycol | 106 | — | 0.1 g/L | D |
| Comparative bath 4 | Triethylene glycol | 150 | — | 0.1 g/L | D |
| Comparative bath 5 | Triethylene glycol | 150 | — | 20 g/L | D |

TABLE 4

| Conductive film-formind bath | Water-soluble polymer Type | Amount added | Adhesiveness |
|---|---|---|---|
| Present invention bath 21 | Polymer 18 | 0.3 ppm | B |
| Present invention bath 22 | Polymer 18 | 0.5 ppm | B |
| Present invention bath 23 | Polymer 18 | 1 ppm | A |
| Present invention bath 24 | Polymer 18 | 5 ppm | A |
| Present invention bath 25 | Polymer 18 | 10 ppm | A |
| Present invention bath 26 | Polymer 18 | 0.1 g/L | A |
| Present invention bath 27 | Polymer 18 | 1 g/L | A |
| Present invention bath 28 | Polymer 18 | 10 g/L | A |

As is clear from the results shown in Tables 1 to 4, plating films with excellent adhesiveness were formed with the use of the conductive film-forming baths (present invention baths (1 to 28) in which a water-soluble polymer having a polyoxyalkylene structure was added to basic bath A, which contained copper sulfate, Rochelle salt, and sodium hydroxide.

In contrast, plating films exhibited unsatisfactory adhesiveness when formed with the use of basic bath A (comparative bath 1) to which water-soluble polymer is not added or baths (comparative baths 2 to 5) in which a water-soluble polyol compound, which is not a polymer, was added to basic bath A.

Example 2 (Reducing Agent Added)

The same substrate to be treated and jig as used in Example 1 were used and the same procedures as in Example 1 were performed up to the catalyst, application step.

After the catalyst application step above, the substrate was sufficiently washed with water, and conductive films were formed under the same conditions as in Example 1, using conductive film-forming baths (present invention baths 29 to 56). For present invention baths 29 to 56, aqueous solutions were used that were obtained by adding the water-soluble polymer having a polyoxyalkylene structure shown in Tables 5 to 7 to an aqueous solution that contains 4.8 g/L of copper sulfate pentahydrate, 30 g/L of disodium ethylenediaminetetraacetate, 30 g/L of sodium hydroxide, and 2 g/L of formaldehyde (hereinafter referred to as "basic bath B"). Thereafter, the resulting product was washed with water, and copper electroplating, nickel plating, and chromium plating were performed under the same conditions as in Example 1. The types of polymers in the tables are the same as those shown in Tables 1 to 3.

For a comparative test, basic bath B to which a water-soluble polymer was not added (comparative bath 6) and basic baths B to which the water-soluble compound shown in Table 6 below was added (comparative baths 7 to 10) were used as conductive film-forming baths to form a conductive film under the same conditions as in Example 1. Thereafter, the resulting product was washed with water, and copper electroplating, nickel plating, and chromium plating were performed under the same conditions as in Example 1.

After plating films were formed by the above method, the adhesiveness of the formed plating films were evaluated as in Example 1. Tables 5 to 7 also show the results.

TABLE 5

| Conductive film-forming bath | Basic bath | Water-soluble polymer Type | Amount added | Adhesiveness |
|---|---|---|---|---|
| Present invention bath 29 | B | Polymer 1 | 0.1 g/L | A |
| Present invention bath 30 | B | Polymer 2 | 0.1 g/L | A |
| Present invention bath 31 | B | Polymer 3 | 0.1 g/L | A |
| Present invention bath 32 | B | Polymer 4 | 0.1 g/L | A |
| Present invention bath 33 | B | Polymer 5 | 0.1 g/L | A |
| Present invention bath 34 | B | Polymer 6 | 0.1 g/L | A |
| Present invention bath 35 | B | Polymer 7 | 0.1 g/L | A |
| Present invention bath 36 | B | Polymer 8 | 0.1 g/L | A |
| Present invention bath 37 | B | Polymer 9 | 0.1 g/L | A |
| Present invention bath 38 | B | Polymer 10 | 0.1 g/L | A |
| Present invention bath 39 | B | Polymer 11 | 0.1 g/L | A |
| Present invention bath 40 | B | Polymer 12 | 0.1 g/L | A |
| Present invention bath 41 | B | Polymer 13 | 0.1 g/L | A |
| Present invention bath 42 | B | Polymer 14 | 0.1 g/L | A |
| Comparative bath 6 | B | Not added | — | D |

TABLE 6

| Conductive film-forming bath | Basic bath | Type of water-soluble polymer | Number average molecular weight | Amount added | Adhesiveness |
|---|---|---|---|---|---|
| Present invention bath 43 | B | Polymer 15 | 300 | 0.1 g/L | B |
| Present invention bath 44 | B | Polymer 16 | 600 | 0.1 g/L | B |
| Present invention bath 45 | B | Polymer 17 | 1000 | 0.1 g/L | A |
| Present invention bath 46 | B | Polymer 18 | 2000 | 0.1 g/L | A |
| Present invention bath 47 | B | Polymer 19 | 8000 | 0.1 g/L | A |
| Present invention bath 48 | B | Polymer 20 | 20000 | 0.1 g/L | A |
| Comparative bath 7 | B | Ethylene glycol | 62 | 0.1 g/L | D |
| Comparative bath 8 | B | Diethylene glycol | 106 | 0.1 g/L | D |
| Comparative bath 9 | B | Triethylene glycol | 150 | 0.1 g/L | D |
| Comparative bath 10 | B | Triethylene glycol | 150 | 20 g/L | D |

TABLE 7

| Conductive film-forming bath | Basic bath | Water-soluble polymer Type | Amount added | Adhesiveness |
|---|---|---|---|---|
| Present invention bath 49 | B | Polymer 18 | 0.3 ppm | B |
| Present invention bath 50 | B | Polymer 18 | 0.5 ppm | B |
| Present invention bath 51 | B | Polymer 18 | 1 ppm | B |
| Present invention bath 52 | B | Polymer 18 | 5 ppm | A |
| Present invention bath 53 | B | Polymer 18 | 10 ppm | A |
| Present invention bath 54 | B | Polymer 18 | 0.1 g/L | A |
| Present invention bath 55 | B | Polymer 18 | 1 g/L | A |
| Present invention bath 56 | B | Polymer 18 | 10 g/L | A |

As is clear from the results shown in Tables 5 to 7, plating films with excellent adhesiveness were formed with the use of the conductive film-forming baths (present invention baths 29 to 56) in which a water-soluble polymer having a polyoxyalkylene structure was added to basic bath B, which contained copper sulfate, disodium ethylenediaminetetraacetate, sodium hydroxide, and formaldehyde.

In contrast, plating films exhibited unsatisfactory adhesiveness when formed with the use of basic bath B to which a water-soluble polymer was not added (comparative bath 6) and basic baths B to which a water-soluble polyol compound, which is not a polymer, was added (comparative baths 7 to 10).

Example 3 (Reducing Agent Added)

The same substrate to be treated and jig as used in Example 1 were used and the same procedures as in Example 1 were performed up to the catalyst application step.

After the catalyst application step above, the substrate was sufficiently washed with water, and conductive films were formed under the same conditions as in Example 1, using conductive film-forming baths (present invention baths 57 to 84). For present invention baths 57 to 84, aqueous solutions were used that were obtained by adding the water-soluble polymer having a polyoxyalkylene structure shown in Tables 8 to 10 to an aqueous solution containing 4 g/L of copper sulfate pentahydrate, 20 g/L of 5,5-dimethylhydantoin, 10 g/L of Rochelle salt, 70 g/L of sodium hydroxide, and 10 g/L of mannitol (hereinafter referred to as "basic bath C"). Thereafter, the resulting product was washed with water, and copper electroplating, nickel plating, and chromium plating were performed under the same conditions as in Example 1. The types of polymers in the tables are the same as those shown in Tables 1 to 3.

For a comparative test, basic bath C to which a water-soluble polymer was not added (comparative bath 11) and basic baths C to which the water-soluble compound shown in Table 9 below was added (comparative baths 12 to 15) were used as conductive film-forming baths to form a conductive film under the same conditions as in Example 1. Thereafter, the resulting product was washed with water, and copper electroplating, nickel plating, and chromium plating were performed under the same conditions as in Example 1.

After plating films were formed by the above method, the adhesiveness of the formed plating films was evaluated as in Example 1. Tables 8 to 10 also show the results.

TABLE 8

| Conductive film-forming bath | Basic bath | Water-soluble polymer Type | Amount added | Adhesiveness |
|---|---|---|---|---|
| Present invention bath 57 | C | Polymer 1 | 0.1 g/L | A |
| Present invention bath 58 | C | Polymer 2 | 0.1 g/L | A |
| Present invention bath 59 | C | Polymer 3 | 0.1 g/L | A |
| Present invention bath 60 | C | Polymer 4 | 0.1 g/L | A |
| Present invention bath 61 | C | Polymer 5 | 0.1 g/L | A |
| Present invention bath 62 | C | Polymer 6 | 0.1 g/L | A |
| Present invention bath 63 | C | Polymer 7 | 0.1 g/L | A |
| Present invention bath 64 | C | Polymer 8 | 0.1 g/L | A |
| Present invention bath 65 | C | Polymer 9 | 0.1 g/L | A |
| Present invention bath 66 | C | Polymer 10 | 0.1 g/L | A |
| Present invention bath 67 | C | Polymer 11 | 0.1 g/L | A |
| Present invention bath 68 | C | Polymer 12 | 0.1 g/L | A |
| Present invention bath 69 | C | Polymer 13 | 0.1 g/L | A |
| Present invention bath 70 | C | Polymer 14 | 0.1 g/L | A |
| Comparative bath 11 | C | None | — | D |

TABLE 9

| Conductive film-forming bath | Basic bath | Type of water-soluble polymer | Number average molecular weight | Amount added | Adhesiveness |
|---|---|---|---|---|---|
| Present invention bath 71 | C | Polymer 15 | 300 | 0.1 g/L | B |
| Present invention bath 72 | C | Polymer 16 | 600 | 0.1 g/L | B |
| Present invention bath 73 | C | Polymer 17 | 1000 | 0.1 g/L | A |
| Present invention bath 74 | C | Polymer 18 | 2000 | 0.1 g/L | A |
| Present invention bath 75 | C | Polymer 19 | 8000 | 0.1 g/L | A |
| Present invention bath 76 | C | Polymer 20 | 20000 | 0.1 g/L | A |
| Comparative bath 12 | C | Ethylene glycol | 62 | 0.1 g/L | D |
| Comparative bath 13 | C | Diethylene glycol | 106 | 0.1 g/L | D |
| Comparative bath 14 | C | Triethylene glycol | 150 | 0.1 g/L | D |
| Comparative bath 15 | C | Triethylene glycol | 150 | 20 g/L | D |

TABLE 10

| Conductive film-forming bath | Basic bath | Water-soluble polymer Type | Amount added | Adhesiveness |
|---|---|---|---|---|
| Present invention bath 77 | C | Polymer 18 | 0.3 ppm | B |
| Present invention bath 78 | C | Polymer 18 | 0.5 ppm | B |
| Present invention bath 79 | C | Polymer 18 | 1 ppm | B |
| Present invention bath 80 | C | Polymer 18 | 5 ppm | A |
| Present invention bath 81 | C | Polymer 18 | 10 ppm | A |
| Present invention bath 82 | C | Polymer 18 | 0.1 g/L | A |
| Present invention bath 83 | C | Polymer 18 | 1 g/L | A |
| Present invention bath 84 | C | Polymer 18 | 10 g/L | A |

As is clear from the results shown in Tables 8 to 10, plating films with excellent adhesiveness were formed with the use of the conductive film-forming baths (present invention baths 57 to 84) in which a water-soluble polymer having a polyoxyalkylene structure was added to basic bath C, which contained copper sulfate, 5,5-dimethylhydantoin, Rochelle salt, sodium hydroxide, and mannitol.

In contrast, plating films exhibited unsatisfactory adhesiveness when formed with the use of basic bath C to which a water-soluble polymer was not added (comparative bath 11) and basic bath C to which a water-soluble polyol compound, which is not a polymer, was added (comparative baths 12 to 15).

Example 4 (Reducing Agent and Aliphatic Polyalcohol Added)

The same substrate and jig as used in Example 1 were used and the same procedures as in Example 1 were performed up to the catalyst application step.

After the catalyst application step above, the substrate was sufficiently washed with water, and conductive films were formed under the same conditions as in Example 1, using conductive film-forming baths (present invention baths 85 to 112). For present invention baths 85 to 112, aqueous solutions were used that were obtained by adding the water-soluble polymer having a polyoxyalkylene structure shown in Tables 11 to 13 to an aqueous solution containing 4 g/L of copper sulfate pentahydrate, 20 g/L of Rochelle salt, 65 g/L of sodium hydroxide, 10 g/L of formic acid, and 50 g/L of glycerin (hereinafter referred to as "basic bath D"). Thereafter, the resulting product was washed with water, and copper electroplating, nickel plating, and chromium plating were performed under the same conditions as in Example 1. The types of polymers in the tables are the same as those shown in Tables 1 to 3.

For a comparative test, basic bath D to which a water-soluble polymer was not added (comparative bath 16) and basic baths C to which the water-soluble compound shown in Table 12 below was added (comparative baths 17 to 20) were used as conductive film-forming baths to form a conductive film under the same conditions as in Example 1. Thereafter, the resulting product was washed with water, and copper electroplating, nickel plating, and chromium plating were performed under the same conditions as in Example 1.

After plating films were formed by the above method, the adhesiveness of the formed plating films were evaluated as in Example 1. Tables 11 to 13 also show the results.

TABLE 11

| Conductive film-forming bath | Basic bath | Water-soluble polymer Type | Amount added | Adhesiveness |
|---|---|---|---|---|
| Present invention bath 85 | D | Polymer 1 | 0.1 g/L | A |
| Present invention bath 86 | D | Polymer 2 | 0.1 g/L | A |
| Present invention bath 87 | D | Polymer 3 | 0.1 g/L | A |
| Present invention bath 88 | D | Polymer 4 | 0.1 g/L | A |
| Present invention bath 89 | D | Polymer 5 | 0.1 g/L | A |
| Present invention bath 90 | D | Polymer 6 | 0.1 g/L | A |
| Present invention bath 91 | D | Polymer 7 | 0.1 g/L | A |
| Present invention bath 92 | D | Polymer 8 | 0.1 g/L | A |
| Present invention bath 93 | D | Polymer 9 | 0.1 g/L | A |
| Present invention bath 94 | D | Polymer 10 | 0.1 g/L | A |
| Present invention bath 95 | D | Polymer 11 | 0.1 g/L | A |
| Present invention bath 96 | D | Polymer 12 | 0.1 g/L | A |
| Present invention bath 97 | D | Polymer 13 | 0.1 g/L | A |
| Present invention bath 98 | D | Polymer 14 | 0.1 g/L | A |
| Comparative bath 16 | D | None | — | D |

TABLE 12

| Conductive film-forming bath | Basic bath | Type of water-soluble polymer | Number average molecular weight | Amount added | Adhesiveness |
|---|---|---|---|---|---|
| Present invention bath 99 | D | Polymer 15 | 300 | 0.1 g/L | B |
| Present invention bath 100 | D | Polymer 16 | 600 | 0.1 g/L | B |
| Present invention bath 101 | D | Polymer 17 | 1000 | 0.1 g/L | A |
| Present invention bath 102 | D | Polymer 18 | 2000 | 0.1 g/L | A |
| Present invention bath 103 | D | Polymer 19 | 8000 | 0.1 g/L | A |
| Present invention bath 104 | D | Polymer 20 | 20000 | 0.1 g/L | A |
| Comparative bath 17 | D | Ethylene glycol | 62 | 0.1 g/L | D |
| Comparative bath 18 | D | Diethylene glycol | 106 | 0.1 g/L | D |
| Comparative bath 19 | D | Triethylene glycol | 150 | 0.1 g/L | D |
| Comparative bath 20 | D | Triethylene glycol | 150 | 20 g/L | D |

TABLE 13

| Conductive film-forming bath | Basic bath | Water-soluble polymer Type | Amount added | Adhesiveness |
|---|---|---|---|---|
| Present invention bath 105 | D | Polymer 18 | 0.3 ppm | B |
| Present invention bath 106 | D | Polymer 18 | 0.5 ppm | B |
| Present invention bath 107 | D | Polymer 18 | 1 ppm | B |
| Present invention bath 108 | D | Polymer 18 | 5 ppm | A |
| Present invention bath 109 | D | Polymer 18 | 10 ppm | A |
| Present invention bath 110 | D | Polymer 18 | 0.1 g/L | A |
| Present invention bath 111 | D | Polymer 18 | 1 g/L | A |
| Present invention bath 112 | D | Polymer 18 | 10 g/L | A |

As is clear from the results shown in Tables 11 to 13, plating films with excellent adhesiveness were formed with the use of the conductive film-forming baths (present invention baths 85 to 112) in which a water-soluble polymer having a polyoxyalkylene structure was added to basic bath D, which contained copper sulfate, Rochelle salt, sodium hydroxide, formic acid, and glycerin.

In contrast, plating films exhibited unsatisfactory adhesiveness when formed with the use of basic bath D to which a water-soluble polymer was not added (comparative bath 16) and basic bath B to which a water-soluble polyol compound, which is not a polymer, was added (comparative baths 17 to 20).

The invention claimed is:

1. A conductive film-forming bath comprising an aqueous solution containing a copper compound, a complexing agent, an alkali metal hydroxide, a water-soluble polymer having a polyoxyalkylene structure, formic acid as a reducing agent, and $C_{2-5}$ aliphatic polyalcohol compound.

2. The conductive film-forming bath according to claim 1, wherein the water-soluble polymer having a polyoxyalkylene structure is with a backbone having a repeating structure of a structural unit: an oxyalkylene group represented by Formula (1): —(O-Ak)-, wherein Ak represents alkylene, and wherein the polymer has one or more hydrophilic groups.

3. The conductive film-forming bath according to claim 1, wherein the water-soluble polymer having a polyoxyalkylene structure has a number average molecular weight of 300 or more.

4. A method for forming a conductive film on a non-conductive plastic material, the method comprising bringing a non-conductive plastic material to which a catalyst substance is applied into contact with the conductive film-forming bath of claim 1.

5. A method for electroplating a non-conductive plastic material, the method comprising a step of performing electroplating after a conductive film is formed using the conductive film-forming bath by the method of claim 4.

6. A conductive film-forming bath comprising an aqueous solution containing a copper compound, a complexing agent, an alkali metal hydroxide, a water-soluble polymer having a polyoxyalkylene structure, and a C2-5 aliphatic polyalcohol compound, wherein a temperature of the conductive film-forming bath is in a range of 55 to 80° C.

7. The conductive film-forming bath according to claim 6, further comprising a reducing agent.

8. The conductive film-forming bath according to claim 7, wherein the reducing agent is at least one component selected from the group consisting of carboxyl-containing reducing compounds and reducing saccharides having 6 or more carbon atoms.

9. The conductive film-forming bath according to claim 6, wherein the water-soluble polymer having a polyoxyalkylene structure is with a backbone having a repeating structure of a structural unit: an oxyalkylene group represented by Formula (1): —(O-Ak)-, wherein Ak represents alkylene, and wherein the polymer has one or more hydrophilic groups.

10. The conductive film-forming bath according to claim 6, wherein the water-soluble polymer having a polyoxyalkylene structure has a number average molecular weight of 300 or more.

11. A method for forming a conductive film on a non-conductive plastic material, the method comprising bringing a non-conductive plastic material to which a catalyst substance is applied into contact with the conductive film-forming bath of claim 6.

12. A method for electroplating a non-conductive plastic material, the method comprising a step of performing electroplating after a conductive film is formed using the conductive film-forming bath by the method of claim 11.

* * * * *